US010390684B2

(12) United States Patent
Chen et al.

(10) Patent No.: US 10,390,684 B2
(45) Date of Patent: Aug. 27, 2019

(54) DRAIN DEVICE

(71) Applicant: Guangdong Yingao Kitchen Utensils Co., Ltd., Foshan, Guangdong (CN)

(72) Inventors: Jiazhi Chen, Guangdong (CN); Huakun Liang, Guangdong (CN)

(73) Assignee: GUANGDONG YINGAO KITCHEN UTENSILS CO., LTD., Foshan (CN)

( * ) Notice: Subject to any disclaimer, the term of this patent is extended or adjusted under 35 U.S.C. 154(b) by 0 days.

(21) Appl. No.: 15/857,565

(22) Filed: Dec. 28, 2017

(65) Prior Publication Data

US 2019/0029493 A1 Jan. 31, 2019

(30) Foreign Application Priority Data

Jul. 25, 2017 (CN) ..... 2017 2 0912447 U

(51) Int. Cl.
*A47L 19/04* (2006.01)

(52) U.S. Cl.
CPC ..... *A47L 19/04* (2013.01)

(58) Field of Classification Search
CPC ..... A47L 19/04; E03C 1/18; E03C 1/33
USPC .... 4/656, 628, 637, 645, 655, 657, 631, 654
See application file for complete search history.

(56) References Cited

U.S. PATENT DOCUMENTS 6,543,069 B1 * 4/2003 Nelson ..... A47L 19/04 211/41.3

* cited by examiner

*Primary Examiner* — Lauren A Crane

(57) ABSTRACT

A drain device includes a first tank body, a second tank body, a third tank body and a drain rack, a bottom surface of the first tank body being mounted and fixed to a top surface of the second tank body, a bottom surface of the second tank body being mounted and fixed to a top surface of the third tank body, the first tank body, the second tank body and the third tank body being in communication with one another to form a washing cavity, a bottom inner side wall of the first tank body being provided with two steps in a lengthwise direction of the first tank body, an inner side wall of the third tank body being provided with two receiving portions in a lengthwise direction of the third tank body, the cross-sectional area of the second tank body gradually increasing from top to bottom.

5 Claims, 2 Drawing Sheets

DRAIN DEVICE

CROSS REFERENCE TO RELATED APPLICATIONS

The present application claims the benefit of Chinese Patent Application No. 201720912447.5 filed on Jul. 25, 2017. All the above are hereby incorporated by reference.

TECHNICAL FIELD

The present application relates to the technical field of kitchen apparatus, and in particular to a drain device.

BACKGROUND ART

Drain tanks are kitchen apparatus commonly used in home kitchens for washing and draining dishes. The existing drain tanks are designed with steps on an inner wall of the tank for the placement of a drain rack, but in order to meet consumers' desire for adjustable height, in the prior art, the height of the drain rack is configured to be adjustable by providing a plurality of steps in the drain tank at different heights. However, regarding this technical solution, as the result of providing steps at different heights, the distance between the inner walls of the drain tank decreases as the height of the steps decreases, and therefore the width dimension of the drain rack also needs to be adjusted according to the distance between the inner walls of the drain tank, so that a plurality of drain racks are required, thereby increasing the production costs. Moreover, the bottom operation space of the drain tank is compressed, which is inconvenient for the washing operation of the washer.

SUMMARY OF THE APPLICATION

In order to overcome the deficiencies of the prior art, an object of the present application is to provide a drain device, which can reduce the production costs and has sufficient washing space at the bottom.

The object of the present application is achieved by the following technical solutions:

a drain device, comprising a first tank body, a second tank body, a third tank body and a drain rack, a bottom surface of the first tank body being mounted and fixed to a top surface of the second tank body, a bottom surface of the second tank body being mounted and fixed to a top surface of the third tank body, the first tank body, the second tank body and the third tank body being in communication with one another to form a washing cavity, a bottom inner side wall of the first tank body being provided with two steps in a lengthwise direction of the first tank body, an inner side wall of the third tank body being provided with two receiving portions in a lengthwise direction of the third tank body, the cross-sectional area of the second tank body gradually increasing from top to bottom, the cross-sectional area of the third tank body gradually decreasing from top to bottom, the distance between the two steps being equal to the distance between the two receiving portions, and the two steps and the two receiving portions being all used for placing the drain rack.

Further, the drain rack comprises a first end, a second end and a plurality of support rods, the support rods being connected between the first end and the second end.

Further, the first end and the second end are each provided with a plurality of small holes, one end of each of the support rods being inserted and connected into one of the small holes provided at the first end, and the other end of each of the support rods being inserted and connected into one of the small holes provided at the second end.

Further, the distance between the first end and the second end is less than that distance between the two steps.

Further, the first tank body and the second tank body are integrally formed, and the second tank body and the third tank body are integrally formed.

Compared with the prior art, the beneficial effects of the present application lie in that: when using such a drain tank, since the distance between the two steps is equal to that between the two receiving portions, the drain rack of the same width can be placed on horizontal surfaces of the steps, or otherwise, the drain rack can be slightly inclined and placed on the two receiving portions, so as to achieve the adjustment of the drain rack of the same size at different heights. Since only the drain rack of the same width is used to achieve the adjustment in height of the drain rack in the drain tank, the number of components and parts is decreased, and the production cost is reduced. Moreover, the cross-sectional area of the second tank body gradually increases from top to bottom, so that the bottom volume of the second tank body will not be compressed, thus ensuring enough washing operation space for the washer and solving the problem that, as the result of the drain tank being provided with steps at different heights, the closer to the bottom of the drain tank, the narrower the washing space is.

Figure 1:
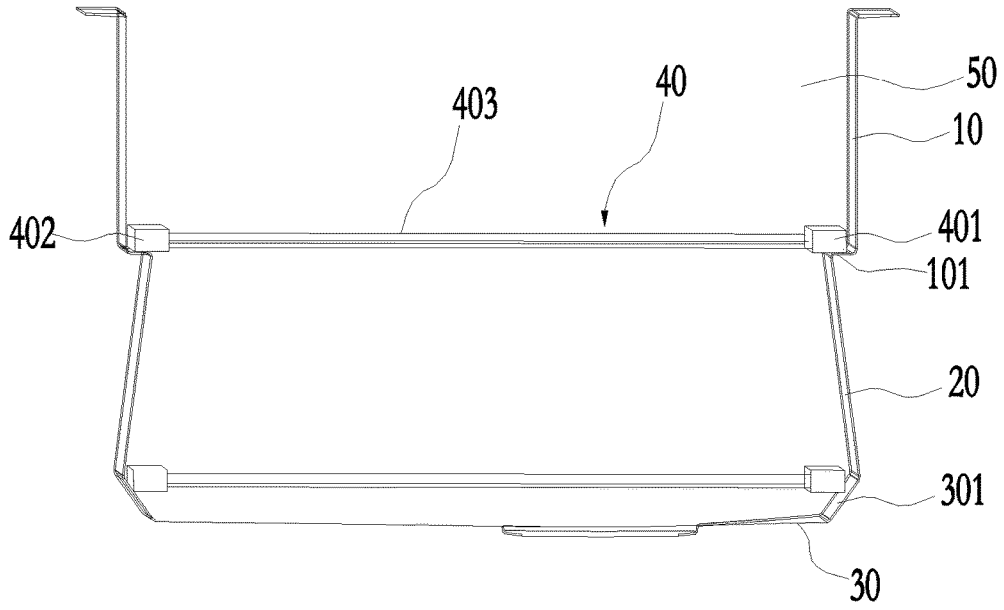
FIG. 1 is a lateral sectional view of a drain device of the present application.

In the drawings: 10. first tank body; 101. step; 20. second tank body; 30. third tank body; 301. receiving portion; 40. drain rack; 401. first end; 402. second end; 403. support rod; 50. washing cavity.

DETAILED DESCRIPTION OF EMBODIMENTS

Hereinafter, the present application will be further described in conjunction with the accompanying drawings and particular embodiments. It should be noted that various embodiments or various technical features described below can be arbitrarily combined to form new embodiments without conflict.

Figure 2:
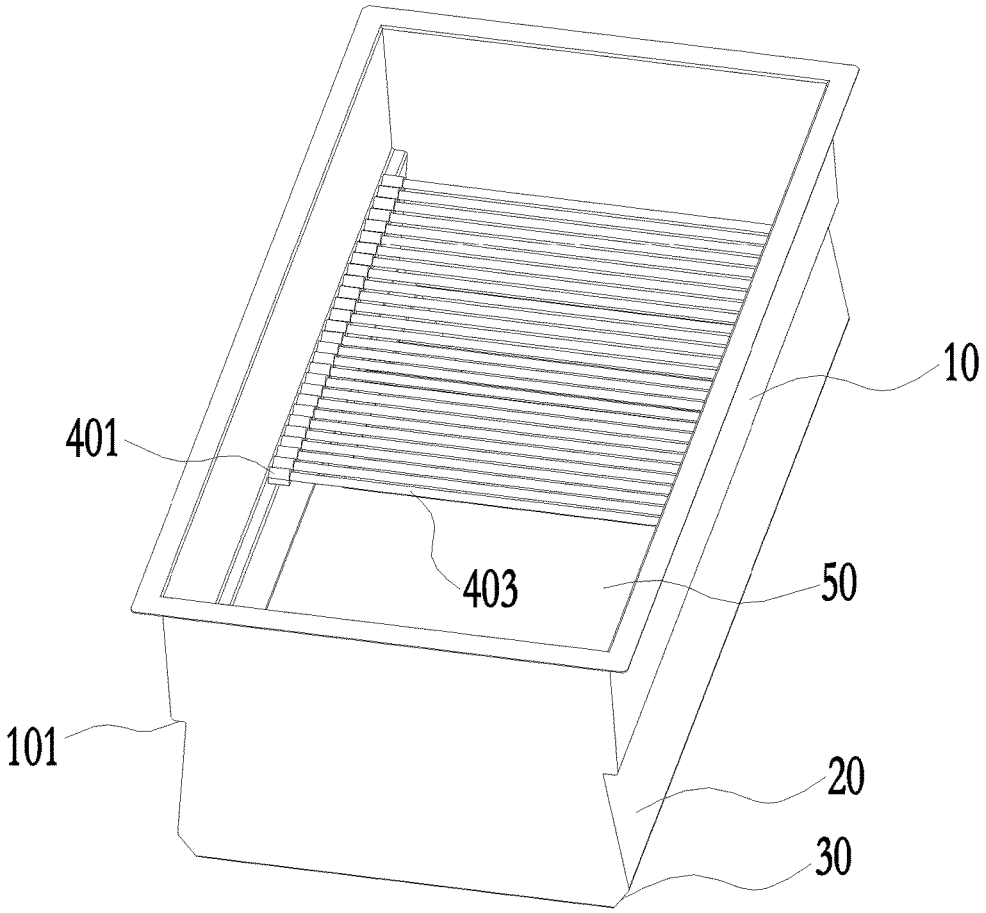
FIG. 2 is a schematic diagram of the overall structure of a drain device of the present application.

As shown in FIGS. 1 and 2, provided is a drain device, comprising a first tank body 10, a second tank body 20, a third tank body 30 and a drain rack 40, a bottom surface of the first tank body 10 being mounted and fixed to a top surface of the second tank body 20, a bottom surface of the second tank body 20 being mounted and fixed to a top surface of the third tank body 30, the first tank body 10, the second tank body 20 and the third tank body 30 being in communication with one another to form a washing cavity 50, a bottom inner side wall of the first tank body 10 being provided with two steps 101 in a lengthwise direction of the first tank body 10, an inner side wall of the third tank body 30 being provided with two receiving portions 301 in a lengthwise direction of the third tank body 30, the cross-sectional area of the second tank body 20 gradually increasing from top to bottom, the cross-sectional area of the third tank body 30 gradually decreasing from top to bottom, and the two steps 101 and the two receiving portions 301 being all used for placing the drain rack 40.

On the basis of the above structure, when using such a drain tank, since the distance between the two steps 101 is equal to that between the two receiving portions 301, the drain rack 40 of the same width can be placed on horizontal surfaces of the steps 101, or the drain rack 40 can be slightly inclined and placed on inclined surfaces of the two receiving portions 301, so as to achieve the adjustment of the drain rack 40 of the same size at different heights. Since only the drain rack 40 of the same width is used to achieve the adjustment in height of the drain rack 40 in the drain tank, the number of components and parts is decreased, and the production cost is reduced. Moreover, the cross-sectional area of the second tank body 20 gradually increases from top to bottom, so that the bottom volume of the second tank body 20 will not be compressed, thus ensuring enough washing operation space for the washer and solving the problem that, as the result of the drain tank being provided with steps 101 at different heights, the closer to the bottom of the drain tank, the narrower the washing space is.

Further, in the present embodiment, the drain rack 40 comprises a first end 401, a second end 402 and a plurality of support rods 403, the support rod 403 being connected between the first end 401 and the second end 402.

Further, in the present embodiment, the first end 401 and the second end 402 are each provided with a plurality of small holes, one end of each of the support rods 403 being inserted and connected into one of the small holes provided at the first end 401, and the other end of each of the support rods 403 being inserted and connected into one of the small holes provided at the second end 402. With the support rods 403 being inserted and connected into the small holes of the first end 401 and the small holes of the second end 402, the integrity is good, and the number of the support rods 403 can be adjusted according to the desired length dimension of the drain rack 40.

Further, the distance between the first end 401 and the second end 402 is less than the distance between the two steps 101, and the advantage of such a design is that the drain rack 40 can conveniently pass through the two steps 401 and thus can be placed on the two receiving portions 301.

Further, in the present embodiment, the first tank body 10 and the second tank body 20 are integrally formed, and the second tank body 20 and the third tank body 30 are integrally formed, thereby enhancing the structural strength of the entire drain tank and simplifying the production process.

Above-mentioned embodiments only are preferred embodiments of the present application, and the scope of protection of the present application should not be limited thereby; and furthermore, all the non-substantial modifications and substitutions made by a person skilled in the art based on the present application are within the scope of protection of the present application.

What is claimed is:

1. A drain device, comprising a first tank body, a second tank body, a third tank body and a drain rack, wherein a bottom surface of the first tank body is mounted and fixed to a top surface of the second tank body, a bottom surface of the second tank body is mounted and fixed to a top surface of the third tank body, the first tank body, the second tank body and the third tank body are in communication with one another to form a washing cavity, a bottom inner side wall of the first tank body is provided with two steps in a lengthwise direction of the first tank body, an inner side wall of the third tank body is provided with two receiving portions in a lengthwise direction of the third tank body, the cross-sectional area of the second tank body gradually increases from top to bottom, the cross-sectional area of the third tank body gradually decreases from top to bottom, the distance between the two steps is equal to the distance between the two receiving portions, and the two steps and the two receiving portions are all configured for supporting the drain rack, and wherein the drain rack spans a space formed between the two steps or a space formed between the two receiving portions.

2. The drain device as claimed in claim 1, wherein the drain rack comprises a first end, a second end and a plurality of support rods, and the support rods are connected between the first end and the second end.

3. The drain device as claimed in claim 2, wherein the first end and the second end are each provided with a plurality of small holes, one end of each of the support rods is inserted and connected into one of the small holes provided at the first end, and the other end of each of the support rods is inserted and connected into one of the small holes provided at the second end.

4. The drain device as claimed in claim 3, wherein the distance between the first end and the second end is less than the distance between the two steps.

5. The drain device as claimed in claim 1, wherein the first tank body and the second tank body are integrally formed, and the second tank body and the third tank body are integrally formed.

* * * * *